US006697596B2

(12) United States Patent
Bessho et al.

(10) Patent No.: US 6,697,596 B2
(45) Date of Patent: Feb. 24, 2004

(54) TRANSFER APPARATUS AND IMAGE FORMING APPARATUS

(75) Inventors: Yuji Bessho, Chiba (JP); Tsuyoshi Watanabe, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/310,045

(22) Filed: Dec. 5, 2002

(65) Prior Publication Data

US 2003/0128999 A1 Jul. 10, 2003

(30) Foreign Application Priority Data

Jan. 7, 2002 (JP) ..... 2002-000404

(51) Int. Cl.[7] ..... G03G 15/01; G03G 15/16

(52) U.S. Cl. ..... 399/302; 399/303; 399/308; 399/313

(58) Field of Search ..... 399/121, 110, 399/154, 297, 162, 126, 302, 308, 313, 312, 303

(56) References Cited

U.S. PATENT DOCUMENTS 5,196,893 A * 3/1993 Nishise et al.
5,291,252 A * 3/1994 Kawaishi ..... 399/308
6,058,286 A * 5/2000 Park ..... 399/121
6,078,777 A 6/2000 Imumi et al. ..... 399/313
6,101,349 A * 8/2000 Ohashi et al. ..... 399/110
6,449,448 B2 9/2002 Bessho et al. ..... 399/149
6,496,673 B2 12/2002 Bessho ..... 399/175

FOREIGN PATENT DOCUMENTS

JP 5-53410 3/1993
JP 7-140805 6/1995
JP 08194392 A * 7/1996
JP 10-221964 8/1998

* cited by examiner

*Primary Examiner*—Sandra Brase
(74) *Attorney, Agent, or Firm*—Fitzpatrick, Cella, Harper & Scinto

(57) ABSTRACT

A transfer apparatus comprising a belt member, a plurality of belt supporting members which drive the belt member while stretching the belt member with a prescribed tension; a transfer member, which is one of the plurality of belt supporting members, and transfers an image formed on an image carrier toward the belt member; and transfer member moving means making it possible only for the transfer member movable between a transfer position where the image is transferred and a non-transfer position where the image is not transferred while maintaining the prescribed tension.

14 Claims, 5 Drawing Sheets

TRANSFER APPARATUS AND IMAGE FORMING APPARATUS

BACKGROUND OF THE INVENTION

1. Field of the Invention

The present invention relates to a transfer apparatus for transferring an image onto a transfer medium by means of a belt member and an image forming apparatus based thereon.

2. Description of the Related Art

In a conventional image forming apparatus such as a laser printer adopting the electrophotography, the process speed is low in many cases, requiring a photosensitive member having only a small diameter. It was therefore the conventional practice to accomplish separation by use of the rigidity of the transfer medium, and provide a stripping charger such as a transfer corona in the downstream of the transfer apparatus as auxiliary means, thereby neutralizing the transfer medium to an extent not causing disturbance of the image. However, along with the recent progress of digitization of image forming apparatuses of copying machines, a high process speed is making it difficult to effect separation by use of rigidity of the transfer medium. There is therefore proposed a method known as the transfer belt process using a belt for the transfer member, and electrostatically absorbing the transfer medium to the belt, thereby conveying and transferring the image.

On the other hand, an electrophotographic full-color image forming apparatus having an intermediate transfer member in addition to an image carrier such as a photosensitive drum is known. This is based on a process comprising the step of repeating a plurality of times a so-called primary transfer which transfers a toner image formed on an image carrier once onto an intermediate transfer member to laminate toner images of a plurality of colors onto the intermediate transfer member, and then secondary-transfers these toner images of the plurality of colors in a lump onto a transfer medium such as a sheet of paper.

While applicable types of intermediate transfer members include the intermediate roller type, apart from the intermediate belt type, the intermediate belt type is more excellent than the intermediate roller type in a higher degree of freedom of arrangement and a higher separability (permitting curvature separation) of the transfer medium after secondary transfer.

The corona transfer process has conventionally be used commonly for transfer purposes because of the advantages including easier construction of the apparatus. However, to cope with environmental problems such as generation of ozone, the general tendency is now directed toward adoption of the contact transfer process.

However, when driving a transfer medium carrying/conveying belt serving as a belt member by bringing the same into contact with a photosensitive drum, or by bringing an intermediate transfer belt serving as a belt member into contact with the photosensitive drum in an image forming apparatus as described above, impossibility to achieve a uniform circumferential speed for both the drum and the belt results in a difference in circumferential speed, and this causes a problem of wearing or damage to the drum and the belt. Wear of, or damage to these components in turn causes problems of defective image or reduction of service life.

To solve these problems, Japanese Patent Laid-Open No. 10-221964 discloses a technique of preventing wearing damage caused by the contact of the transfer medium carrying/conveying belt with the photosensitive drum by separating the contact transfer means except during image formation, and providing an auxiliary member for making up for a decrease in the tension of the loosening belt by separating the contact charging means. With the technique disclosed by Japanese Patent Laid-Open No. 10-221964, however, it is necessary to provide new auxiliary means for maintaining the belt tension. This leads to a more complicated configuration and to the need for ensuring a space for the auxiliary means, resulting in a cost increase and scaling-up of the apparatus. When problems such as those mentioned above are encountered between the intermediate transfer belt and the photosensitive member including frictions or other damage between the intermediate transfer belt and the photosensitive member, it is impossible to cope with these problems.

According to Japanese Patent Laid-Open Nos. 5-53410 and 7-140805, color shift can be prevented by providing a support structure permitting simultaneous swinging of a pulley opposite to the photosensitive member and a tension pulley, making the photosensitive member and the intermediate transfer member separable from each other, and adopting a configuration not causing a decrease in the intermediate transfer member belt tension. However, because of the necessity to simultaneously move two rollers for keeping a constant belt tension, the structure becomes more complicated, leading to an increase in cost.

SUMMARY OF THE INVENTION

An object of the present invention is to ensure stable belt conveyance by moving the transfer member between a transfer position and a non-transfer position while maintaining the tension of the belt member.

The present invention provides a transfer apparatus comprising a belt member, a plurality of belt supporting members which drive the belt member while stretching the belt member with a prescribed tension, a transfer member, which is one of the plurality of belt supporting members, and transfers an image formed on an image carrier toward the belt member, and transfer member moving means making it possible only for the transfer member movable between a transfer position where the image is transferred and a non-transfer position where the image is not transferred while maintaining the prescribed tension.

The present invention provides also an image forming apparatus comprising image forming means which forms an image on an image carrier, a belt member, a plurality of belt supporting member which drive the belt member while stretching the same with a prescribed tension, a transfer member which is one of the plurality of belt supporting members, and transfers an image formed on the image carrier toward the belt member, and transfer member moving means which makes it possible only for the transfer member to a transfer position where the image is transferred and to a non-transfer position where the image is not transferred, while maintaining the prescribed tension.

Further objects, features and advantages of the present invention will become apparent from the following description of the preferred embodiments (with reference to the attached drawings).

DESCRIPTION OF THE PREFERRED EMBODIMENTS (First Embodiment)

Figure 1:
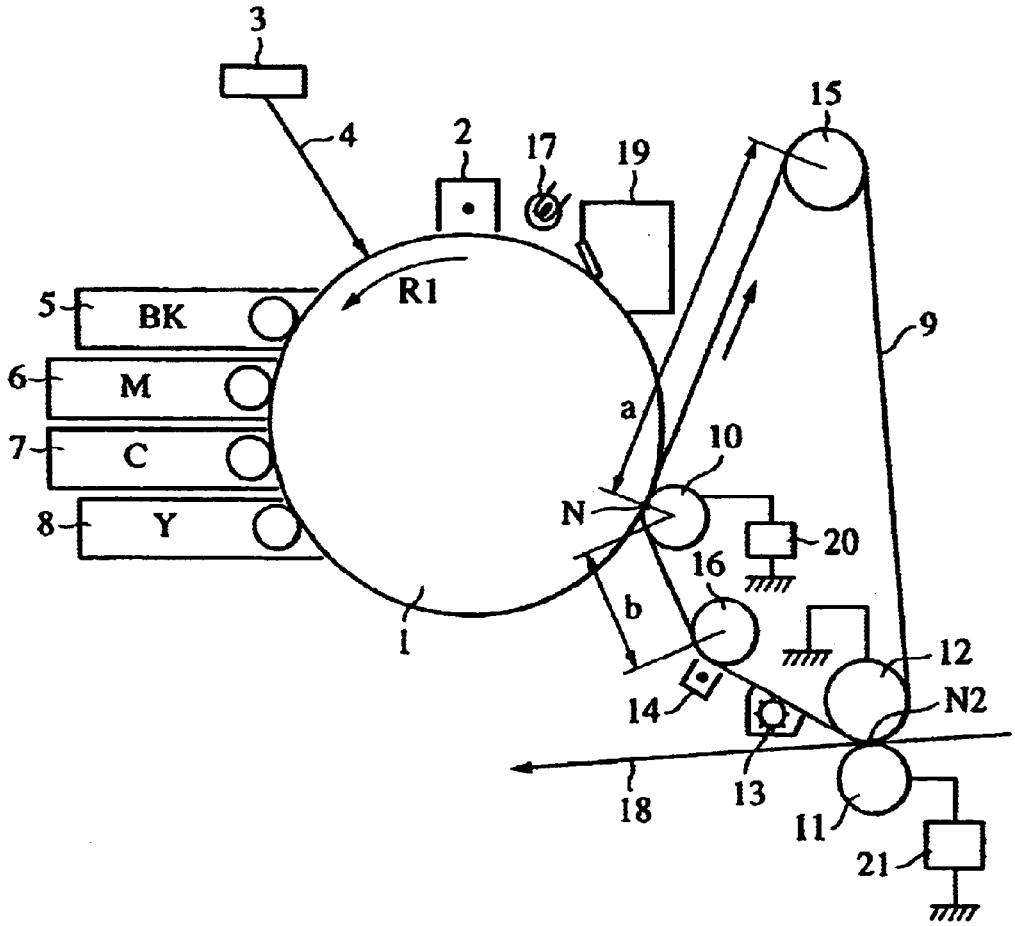
FIG. 1 illustrates an image forming apparatus of which the transfer member is at a transfer position.
Figure 2:
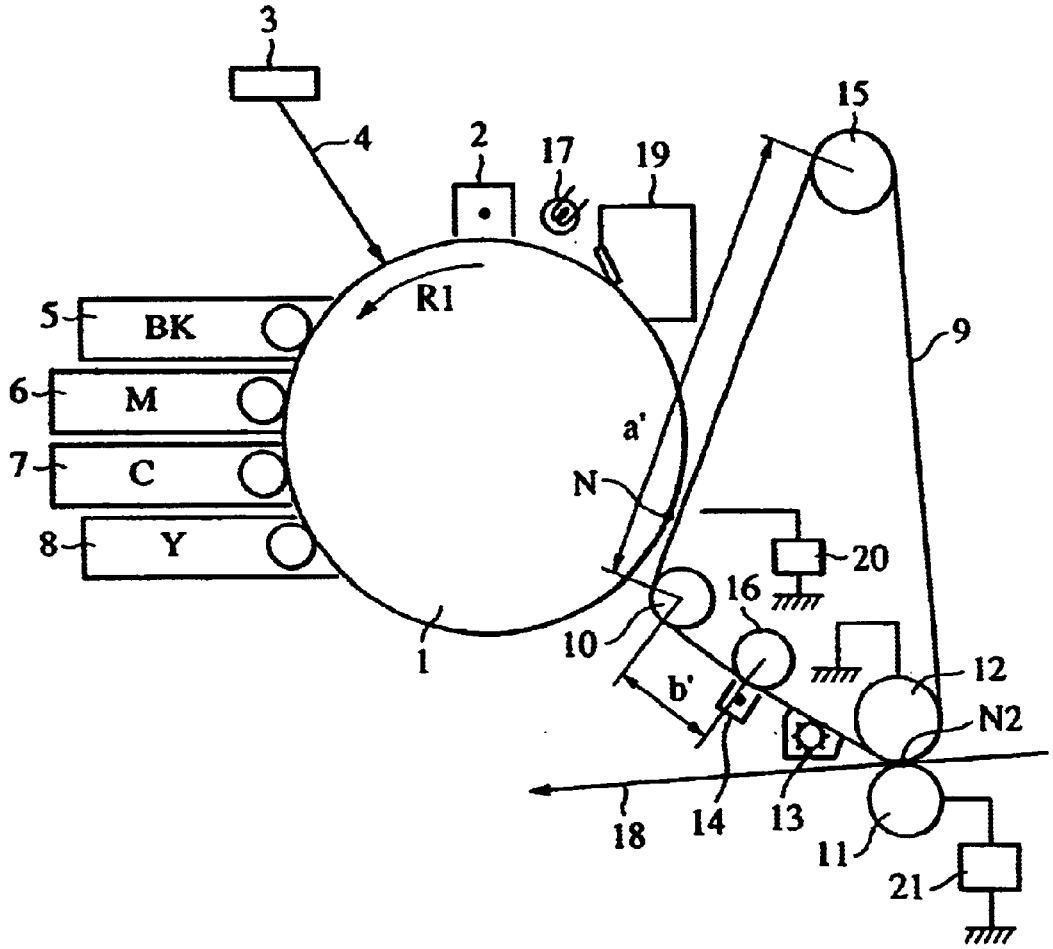
FIG. 2 illustrates an image forming apparatus of which the transfer member is at a non-transfer position.

A first embodiment of the present invention will be described with reference to the drawings. FIGS. 1 and 2 are descriptive views of the image forming apparatus. In the image forming apparatus using an intermediate transfer member of the first embodiment, a primary transfer roller has a first position and a secondary position so as to prevent wearing damage of the photosensitive drum and the intermediate transfer member caused by friction between the photosensitive member and the intermediate transfer member in the primary transfer section.

The image forming apparatus will first be described in detail. FIGS. 1 and 2 illustrate typical image forming apparatuses each using an intermediate transfer member. The image forming apparatus shown in FIG. 1 has a photosensitive drum 1 serving as an image carrier. Four developing units 5, 6, 7 and 8 housing toner of four colors including black (BK), magenta (M), cyan (C) and yellow (Y), serving as developers in these colors are arranged around the photosensitive drum 1 rotatably supported in the arrow R1 direction. In this configuration, from among these developing units, one to be subjected to development of an electrostatic latent image on the photosensitive drum 1 is brought into contact with the photosensitive drum 1 by a separating means (not shown).

The photosensitive drum 1 is uniformly charged by a charger 2, and an electrostatic image is formed thereon by a scanning light (laser beam) emitted by a laser exposing optical system 3 or the like. Then, the electrostatic latent image is developed into a toner image through deposition of the toner in the developing units 5 to 8, and sequentially primary-transferred onto the intermediate transfer belt (intermediate transfer member) 9 serving as a belt member.

Formation of the above-mentioned electrostatic latent image and development is sequentially for the four colors in the developing units 5 to 8. As a result, a toner image of four laminated colors is formed on the intermediate transfer belt 9. Then, the toner image on the intermediate transfer belt 9 is secondary-transferred in a lump onto a transfer medium 18 held and conveyed by a secondary transfer roller 11 and a secondary transfer roller 12.

The above-mentioned primary and secondary transfers will now be described further in detail. First, in the case where the photosensitive drum 1 is composed of, for example, a negative-polarity OPC (organic photosemiconductor) photosensitive member, when developing an exposure portion of a laser beam 4 in the developing units, a negative-polarity toner is employed. Therefore, a positive-polarity transfer bias is impressed onto the primary transfer roller 10 by a bias power source 20.

The intermediate transfer belt 9 is usually formed into an endless shape by use of a resin film (resistance-adjusted as required) made of PVdF (polyvinylidene fluoride), nylon, PET (polyethyleneterephthalate), polycarbonate, or polyimide having a thickness from 50 to 200 $\mu$m and a resistance value from $10^8$ to $10^{16}$ $\Omega\cdot$cm, and stretched over stretching rollers (a secondary transfer roller 12, a driving roller 15, a back roller 16, or the like).

A low-resistance roller having a resistance value of $10^6$ $\Omega\cdot$cm or lower is used as the primary transfer roller 10. By employing a thin film as the intermediate transfer belt 9, a considerable electrostatic capacitance from several hundred to several thousands pF is ensured at the primary transfer nip portion N. It is thus possible to obtain a stable transfer current.

In the above description, the primary transfer means is composed of the primary transfer roller 10 and the bias power source 20. Another feature of this embodiment is that the primary transfer roller 10 is a transfer roller and serves also as a supporting roller which supports the intermediate transfer belt 9.

By adopting the above-mentioned configuration, the photosensitive drum is kept in contact during image formation, and during the time except for image forming (during primary transfer), the drum can be kept in the non-contact state without slackening the belt tension. As a result, because the belt tension is not slackened even in the non-contact state, the belt can be rotated without causing a slip, and this provides an advantage of eliminating the necessity of a special auxiliary member for avoiding belt slackening (maintaining the tension).

Then, secondary transfer of the toner image is carried out onto the transfer medium 18 by secondary transfer means composed of a secondary transfer roller 11, a secondary transfer roller 12, a bias power source 21 and the like. The secondary transfer is accomplished by arranging the low-resistance secondary transfer roller 12, as an opposite electrode, onto which grounding or an appropriate bias is impressed, on the inside of the intermediate transfer belt 9, holding the intermediate transfer belt 9 between the secondary transfer roller 12 and the low-resistance secondary transfer roller 11 arranged outside to compose a secondary transfer nip portion N2, impressing a positive-polarity transfer bias onto the secondary transfer roller 11 by the bias power source 21, and bringing this secondary transfer roller 11 into contact with the transfer medium 18 from back.

Upon the completion of the above-mentioned primary transfer, the residual toner remaining on the photosensitive drum 1 after transfer is removed by a cleaner 19 and collected. Residual charge is removed by means of an exposure unit 17 for the next run of image forming. On the other hand, residual toner remaining on the intermediate transfer belt 9 upon the completion of the above-mentioned secondary transfer is removed by a cleaner 13, and the belt is neutralized by a neutralizing charger 14.

In the above-mentioned image forming apparatus, the position of the transfer roller during primary transfer is as shown in FIG. 1 (first position). The primary transfer roller 10 however comes off the contact position with the photosensitive drum 1 and moves to a position not impairing the belt tension (second position) as shown in FIG. 2 during the time other than image forming for the above-mentioned purpose.

The second position does not cause a change in the sum (a+b) of the distance "a" between the driving roller 15 and the primary transfer roller 10 shown in FIG. 1 and the distance "b" between the back roller 16 and the primary transfer roller 10. When, in FIG. 2, the distance between the driving roller 15 and the primary transfer roller 10 is distance "a'", and the distance between the back roller 16 and the primary transfer roller 10 is "b''''", then, a'+b'=a+b. As a result of the primary transfer roller 10 taking the second position during the time other than during the primary transfer, the time during which the photosensitive drum 1 and the intermediate transfer belt 9 are in contact is reduced, thus permitting minimization of the risk of damages such as wear, flaws and scratches of the photosensitive drum 1 and the intermediate transfer belt 9.

When the primary transfer roller 10 takes the second position, it is desirable to achieve a roller arrangement so that the winding angle of the intermediate transfer belt 9 onto the driving roller 15 is smaller than in the case of the first position.

More specifically, the winding length of the intermediate transfer belt 9 onto the driving roller 15 in the belt conveying direction when the primary transfer roller 10 is at the non-transfer position should preferably be longer than the winding length of the intermediate transfer belt 9 onto the driving roller 15 in the belt conveying direction when the primary transfer roller 10 is at the transfer position.

As a result, the length of the intermediate transfer belt 9 onto the driving roller 15 does not change even at the non-transfer position, thus permitting prevention of inconveniences in conveyance caused by a slip or the like.

If it is possible to keep a tension not causing a slip slightly before or after the primary transfer roller 10 takes the second position, it is not always necessary to retain (a+b).

A negative-polarity OPC drum is used as the photosensitive drum 1 in this embodiment. The same advantages are however available with a drum having a configuration other than this such as a positive/negative-polarity amorphous silicon drum.

As a result, the tension of the intermediate transfer belt 9 can be kept on a satisfactory level while separating the intermediate transfer belt 9 from the photosensitive drum 1 without the need to add a member for stretching the belt.

A typical mechanism for moving the primary transfer roller 10 will be described with reference to FIGS. 3 and 4.

Figure 3:
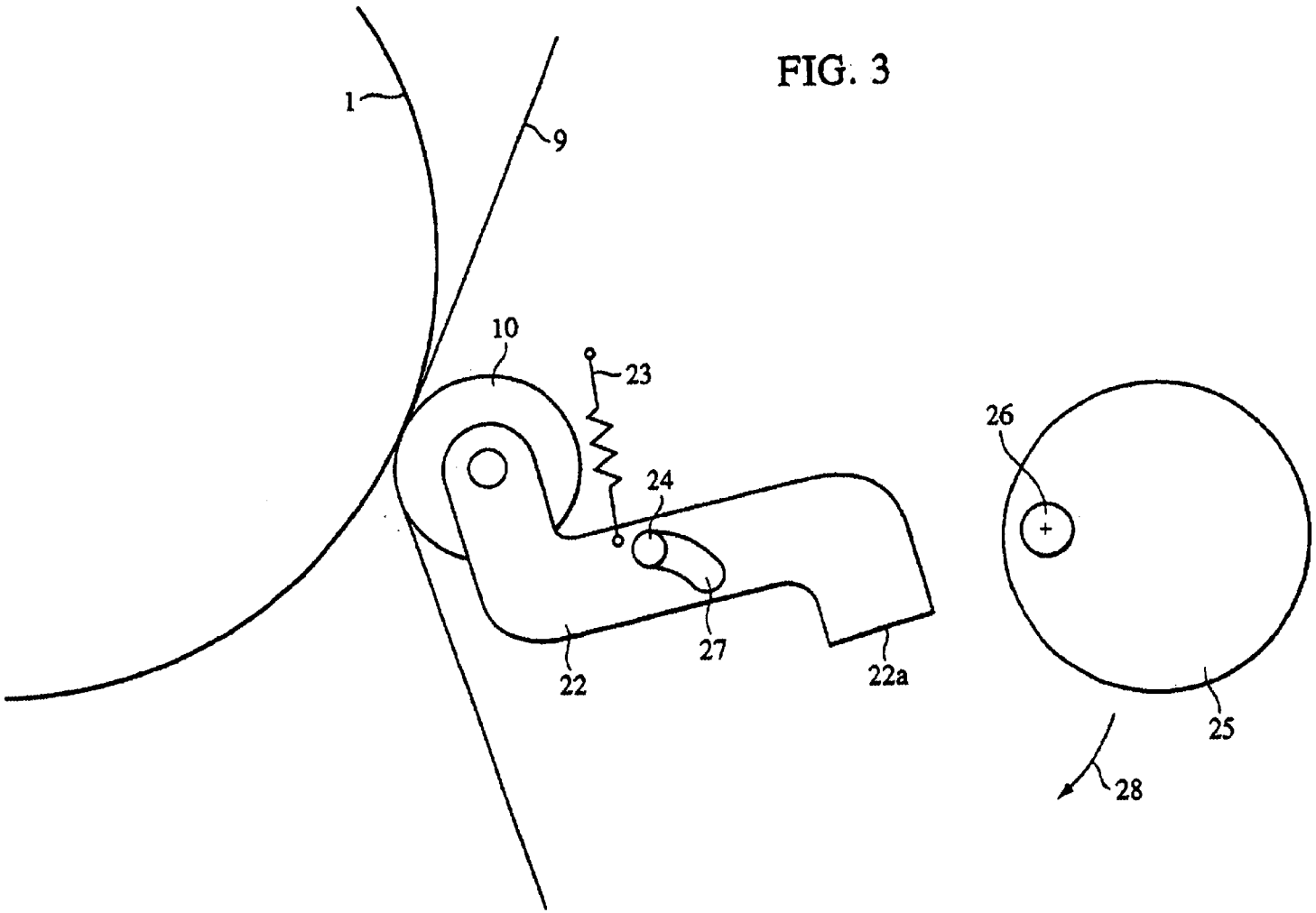
FIG. 3 illustrates a state of the moving mechanism when the transfer member is at the transfer position.

FIG. 3 illustrates the primary transfer roller 10 ready for transferring. FIG. 4 illustrates the primary transfer roller 10 in the non-transfer state. In FIGS. 3 and 4, the primary transfer roller 10 is rotatably supported by the supporting member 22, and the supporting member 22 is movable within a range permitting engagement of a long hole 27 provided in the supporting member 22 and a shaft 24 provided on the apparatus main body side. The supporting member 22 is pulled by a spring member serving as a force-imparting member toward the apparatus main body side. An eccentric cam 25 is rotatable around a rotating axis 26. When the eccentric cam 25 rotates in the arrow 28 direction in FIG. 3, the cam 25 comes into contact with a cam contact surface 22*a* of the supporting member 22, and moves the supporting member 22 with a shaft 24 as the fulcrum within a range of the long hole 27 while opposing to the pulling force of the spring member 23. In a state in which the shaft 24 comes into contact with the end on the opposite side of the long hole 27, displacement by the cam comes to an end into the non-transfer state in FIG. 4.

Figure 4:
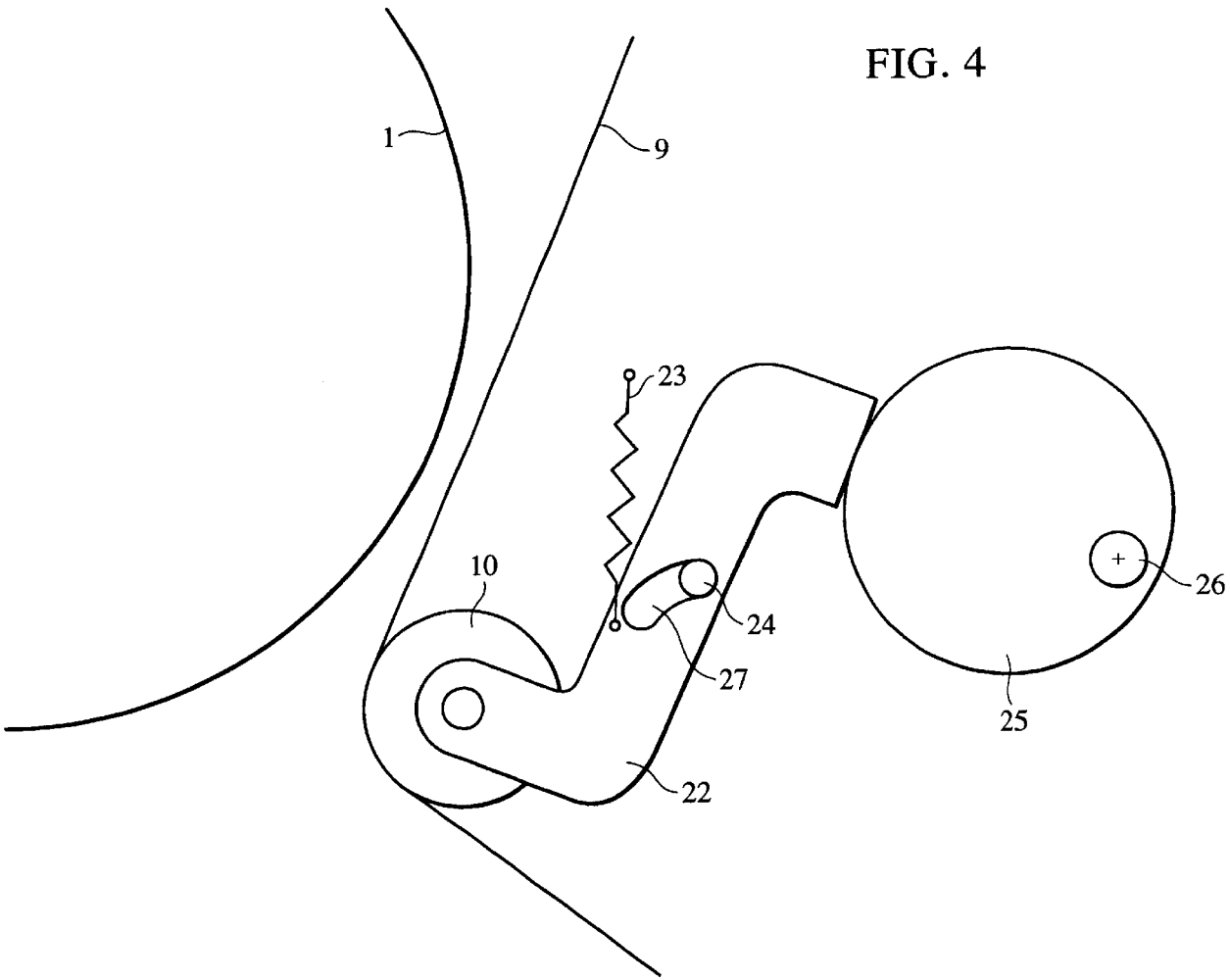
FIG. 4 illustrate a state of the moving mechanism when the transfer member is at the non-transfer position.

In order to convert the non-transfer state of FIG. 4 into the transfer state of FIG. 3, it suffices to move the cam 25 in a direction counter to that described above.

By using the above-mentioned transfer roller moving mechanism, the primary transfer roller 10 can be moved while maintaining the tension imparted to the intermediately transfer belt 9.

It is needless to mention that even a mechanism other than that described above may be employed so far as the advantages of the invention is available.

(Second Embodiment)

A second embodiment of the present invention will now be described with reference to the drawings. FIGS. 5A thru 5E illustrate the hollowing phenomenon. The same components as those in the aforementioned embodiment are assigned the same reference numerals, and the description is omitted herein.

As a counter-measure against a so-called hollowing phenomenon in which, upon transfer of a toner image, particularly in the case of lines such as a character, the center portion except for the edge portions of the line is not transferred, the image forming apparatus of this embodiment adopts the contact transfer process. Upon occurrence of hollowing, damages caused by wear of the photosensitive drum 1 and the intermediate transfer belt 9 can be minimized even when a difference in circumferential speed is intentionally provided between the photosensitive drum 1 and the transfer medium carrying/conveying belt serving as a belt member, or between the photosensitive drum 1 and the intermediate transfer belt 9 serving as a belt member.

Figure 5A:
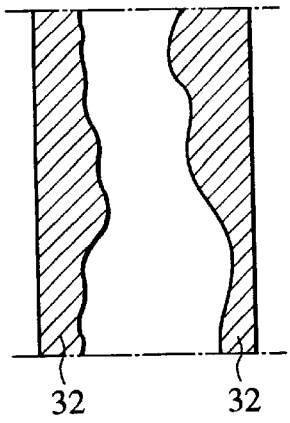
FIGS. 5A thru 5E illustrate the hollowing phenomenon.
Figure 5B:
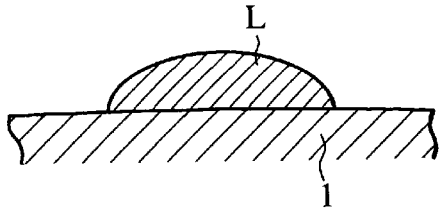
Figure 5C:
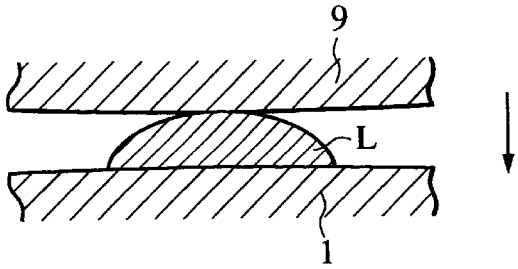

FIG. 5A is a top view of a toner line image in which hollowing has occurred in the center portion is not transferred except for the edge portions of the line; and FIG. 5B is a sectional view of a toner line image L formed by development on the photosensitive drum 1. As shown in FIG. 5C, the intermediate transfer belt 9 comes into contact with the transfer area of this toner line image L, and primary transfer of the toner line image L is carried out. A pressure acts on the toner image L in the arrow direction in the drawing as a result of a pressing force exerted by a primary transfer roller 10 not shown, an electrostatic suction force between the intermediate transfer belt 9 and the photosensitive drum 1.

Figure 5D:
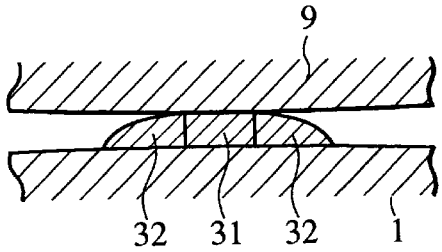

As shown in FIG. 5D, the center portion 31 of the toner image L receives a higher partial pressure which separates the toner than the both side portions (edge portions) 32, and this strengthens the cohesive force between toner particles. When the intermediate transfer belt 9 leaves the photosensitive drum 1, the toner on the surface of the photosensitive drum 1 remains on the surface thereof under the van der Waals force or the like.

Figure 5E:
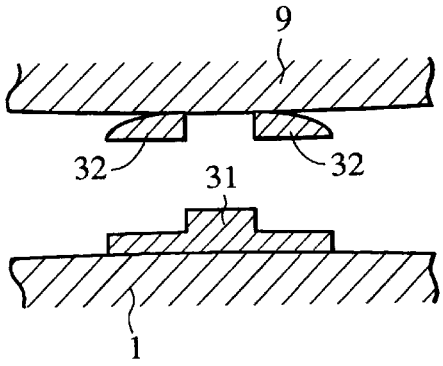

The toner in the center portion 31 in the toner image L finally remains on the photosensitive drum 1, together with the toner remaining on the surface of the photosensitive drum 1 because of a strong cohesive force. As a result, as shown in FIG. 5E, only the toner on the edge portion 32 of the toner line image L is transferred onto the intermediate transfer belt 9, resulting in a transferred toner image suffering from a hollowing phenomenon as shown in FIG. 5A.

A practice of providing a difference in the circumferential speed between the intermediate transfer belt 9 and the photosensitive drum 1 and physically peeling off the toner image is known for such a case to have a remarkable effect on hollowing. In this embodiment as well, driving the intermediate transfer belt 9 faster than the photosensitive drum 1 by 2% is confirmed to be effective in avoiding hollowing.

In the conventional art, however, provision of a difference in circumferential speed results in a serious increase of damages caused by friction between the intermediate transfer belt 9 and the photosensitive drum 1, leading to a decrease in the service life for the both components.

In this embodiment, as in the first embodiment, the first transfer roller 10 during primary transfer takes the first position as shown in FIGS. 1 and 3 (a position where the photosensitive drum 1 and the first transfer roller 10 are in contact with each other via the intermediate transfer belt 9), and during the time other than image forming, takes the second position as shown in FIGS. 2 nd 4, i.e., the position where the first transfer roller 10 is moved to a position off the contact position with the photosensitive drum 1 and not impairing the belt tension. This reduces the period of time for which the photosensitive drum 1 and the intermediate transfer belt 9 are in contact, thus permitting minimization of damages such as wear, flaws and scratches resulting from friction between the photosensitive drum 1 and the intermediate transfer belt 9.

(Other Embodiments)

In the above-mentioned embodiment, a four-color laser printer has been described as an image forming apparatus. The present invention is not however limited to this, but is applicable as an image forming apparatus to a copying machine or a facsimile machine having an image reader section, and the apparatus may be monochromatic, not a color one.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A transfer apparatus comprising:

a belt member;

a plurality of belt supporting members, which support said belt member when said belt member is driven in a belt conveying direction and stretch said belt member with a prescribed tension;

a transfer member, which is one of said plurality of belt supporting members, and transfers an image formed on an image carrier toward said belt member; and transfer member moving means for moving only said transfer member among said plurality of belt supporting members to a transfer position for transferring said image and a non-transfer position for not transferring said image while maintaining the prescribed tension.

2. A transfer apparatus according to claim 1, wherein one of said plurality of belt supporting members includes:

a driving roller, which drives said belt member, wherein said transfer member is disposed adjacent to said driving roller, and wherein a length of said belt member wound on said driving roller in the belt conveying direction when said transfer member is at the non-transfer position is longer than a length of said belt member wound on said driving roller in the belt conveying direction when said transfer member is at the transfer position.

3. A transfer apparatus according to claim 1, wherein said plurality of belt supporting members include a first belt supporting member arranged downstream of said transfer member in the belt conveying direction, and a second belt supporting member arranged upstream of said transfer member in the belt conveying direction, and wherein if a distance between said transfer member and said first belt supporting member is represented by "a", and a distance between said transfer member and said second belt supporting member is represented by "b", the total distance of "a"+"b" is substantially the same when said transfer member is at the transfer position, as when said transfer member is at the non-transfer position.

4. A transfer apparatus according to claim 1, wherein said transfer member moving means includes:

a transfer member supporting member movable while supporting said transfer member; and a supporting member moving mechanism, which moves said transfer member supporting member.

5. A transfer apparatus according to claim 4, wherein said supporting member moving mechanism includes a cam member.

6. A transfer apparatus according to claim 1, wherein each of said plurality of belt supporting members includes a roller member.

7. A transfer apparatus according to claim 1, wherein said belt member is an intermediate transfer belt onto which an image on said image carrier is transferred.

8. An image forming apparatus comprising:

image forming means, which forms an image on an image carrier;

a belt member;

a plurality of belt supporting members, which support said belt member when said belt member is driven in a belt conveying direction and stretch said belt member with a prescribed tension;

a transfer member, which is one of said plurality of belt supporting members, and transfers an image formed on the image carrier toward said belt member; and transfer member moving means for moving only said transfer member among said plurality of belt supporting members to a transfer position for transferring said image and a non-transfer position for not transferring said image, while maintaining the prescribed tension.

9. An image forming apparatus according to claim 8, wherein one of said plurality of belt supporting members includes:

a driving roller, which drives said belt member, wherein said transfer member is disposed adjacent to said driving roller, and wherein a length of said belt member wound on said driving roller in the belt conveying direction when said transfer member is at the non-transfer position is longer than a length of said belt member wound on said driving roller in the belt conveying direction when said transfer member is at the transfer position.

10. An image forming apparatus according to claim 8, wherein said plurality of belt supporting members include a first belt supporting member arranged downstream of said transfer member in the belt conveying direction, and a second belt supporting member arranged upstream of said transfer member in the belt conveying direction, and wherein if a distance between said transfer member and said first belt supporting member is represented by "a", and a distance between said transfer member and said second belt supporting member is represented by "b", the total distance of "a"+"b" is substantially the same when said transfer member is at the transfer position as when said transfer member is at the non-transfer position.

11. An image forming apparatus according to claim 8, wherein said transfer member moving means includes:

a transfer member supporting member movable while supporting said transfer member; and a supporting member moving mechanism, which moves said transfer member supporting member.

12. An image forming apparatus according to claim 11, wherein said supporting member moving mechanism includes a cam member.

13. An image forming apparatus according to claim 8, wherein said plurality of belt supporting members are roller members.

14. An image forming apparatus according to claim 8, wherein said belt member is an intermediate transfer belt onto which an image on said image carrier is transferred, and an image on said intermediate transfer belt is transferred to a transfer medium.

* * * * *

UNITED STATES PATENT AND TRADEMARK OFFICE

CERTIFICATE OF CORRECTION

PATENT NO. : 6,697,596 B2 
DATED : February 24, 2004
INVENTOR(S) : Yuji Bessho et al.

It is certified that error appears in the above-identified patent and that said Letters Patent is hereby corrected as shown below:

Column 1,
Line 47, “be” should read -- been --.

Column 2,
Line 48, “member which” should read -- members which --.

Column 3,
Line 3, “illustrate” should read -- illustrates --.

Column 4,
Line 59, “distance “a’”, should read -- distance “a’” --; and
Line 60, “is “b”“,” should read -- is “b’” --.

Column 5,
Line 1, “When” should read -- ¶When --;
Line 5, “More” should read -- ¶More --;
Line 12, “As” should read -- ¶As --;
Line 15, “If” should read -- ¶If --;
Lines 18 and 27, “A” should read -- ¶A --;
Line 23, “As” should read -- ¶As --;
Line 29, “FIG. 3” should read -- ¶FIG. 3 --;
Line 48, “In” should read -- ¶In --;
Line 50, “By” should read -- ¶By --;
Line 52, “intermediately” should read -- intermediate --; and
Line 54, “It should read -- ¶It --.

Column 6,
Line 55, “FIGS. 2 nd 4,” should read -- FIGS. 2 and 4, --.

Signed and Sealed this

Thirteenth Day of July, 2004

JON W. DUDAS
*Acting Director of the United States Patent and Trademark Office*